US007281709B2

(12) United States Patent
Honegger

(10) Patent No.: US 7,281,709 B2
(45) Date of Patent: Oct. 16, 2007

(54) METHOD AND DEVICE FOR ESTABLISHING A STREAM OF FLAT ARTICLES OF DIFFERENT ARTICLE TYPES, IN PARTICULAR A STREAM TO BE SUPPLIED TO A STACKING OPERATION

(75) Inventor: Werner Honegger, Bäch (CH)

(73) Assignee: Ferag AG, Hinwil (CH)

( * ) Notice: Subject to any disclaimer, the term of this patent is extended or adjusted under 35 U.S.C. 154(b) by 555 days.

(21) Appl. No.: 10/839,191

(22) Filed: May 5, 2004

(65) Prior Publication Data

US 2004/0256786 A1 Dec. 23, 2004

(30) Foreign Application Priority Data

May 8, 2003 (CH) ..... 0808/03

(51) Int. Cl.
*B65H 3/44* (2006.01)

(52) U.S. Cl. ..... 271/9.01; 271/9.04; 271/9.12; 271/9.13

(58) Field of Classification Search ..... 271/9.01, 271/9.04, 9.12, 9.13; 198/363, 370.01, 370.1, 198/418.2, 418.3, 431, 448; 270/58.01, 58.23, 270/58.25, 58.29

See application file for complete search history.

(56) References Cited

U.S. PATENT DOCUMENTS 3,966,186 A 6/1976 Helm
4,402,496 A 9/1983 Muller
5,415,385 A * 5/1995 Newsome et al. ..... 270/58.25
5,685,531 A 11/1997 Auerbach et al.
5,727,781 A * 3/1998 Muller ..... 270/58.23
2003/0015837 A1 1/2003 Reist

FOREIGN PATENT DOCUMENTS

DE 199 40 406 C1 10/2000
EP 0 579 940 A1 1/1994
EP 1 029 705 A1 2/2000

* cited by examiner

*Primary Examiner*—David H. Bollinger
(74) *Attorney, Agent, or Firm*—Rankin, Hill, Porter & Clark LLP

(57) ABSTRACT

A stream of flat articles is to include imbricated formations (26.1, 26.2, 26.3) of different article types (A, B, C) and differing numbers of articles of the different types. For establishing such a stream a succession of supply devices (23.1, 23.2, 23.3) and a conveying surface are provided, the supply devices being equipped for preparing the imbricated formations (26.1, 26.2, 26.3) and for depositing whole preformed imbricated formations on the conveying surface. A device for establishing the stream of flat articles includes a main conveyor (21) with the conveying surface (21) and for each other device (23.1, 23.2, 23.3) an article source (25) and an intermediate conveyor (24), wherein the supply devices are controlled independently of each other and wherein the intermediate conveyor (24) and the article source (25) of one supply device may be driven independently of one another. The established stream is particularly suitable for being supplied to a stacking device, wherein the stacks produced in the stacking device are to contain printed products of different types.

16 Claims, 4 Drawing Sheets

METHOD AND DEVICE FOR ESTABLISHING A STREAM OF FLAT ARTICLES OF DIFFERENT ARTICLE TYPES, IN PARTICULAR A STREAM TO BE SUPPLIED TO A STACKING OPERATION

FIELD OF THE INVENTION

The invention is situated in the field of piece goods processing and it concerns a method and a device for establishing a stream of flat articles of different article types, in particular a stream to be supplied to a stacking operation. The flat articles are in particular printed products, such as newspapers and/or brochures, which are processed to stacks or packages, wherein each stack or package contains printed products of a plurality of product types.

BACKGROUND OF THE INVENTION

Stacks of printed products, such as newspapers, magazines or brochures are produced in particular for dispatch. Such stacks are made into packages by strapping and/or wrapping. If produced for retailer supply, such packages frequently contain varying numbers of printed products of different product types. For producing the packages, the products of the different product types are e.g. taken from storage formations (rolls, bundles, stacks, packages) or they are supplied to the stacking operation on-line, i.e. directly from the printing press.

According to the prior art, stacks or packages of printed products are produced, for example, by conveying an imbricated stream of the printed products to be stacked to a stacking shaft and by depositing the products in the stacking shaft. When the stack being produced in the stacking shaft has reached a predefined height or when it contains a predefined number of printed products, it is pushed out of the stacking shaft, if so required directly into a strapping device, in which the stack is strapped or wrapped.

For producing stacks containing products of different types, a device carrying the stack being produced is moved to a plurality of feed points, wherein at each feed point products of one product type are added. Alternately, a supply stream is to be established, in which the products of different types are supplied to the stacking operation in the sequence required by the sequence of packages to be produced.

Establishing supply streams of printed products of different product types is known, for example, from the bookbinding industry, where, streams of signatures are supplied to, for example, stitching or stapling or binding machines. In such streams, the different signatures are arranged in the sequence of the books to be produced. Establishment of such streams is described, for example in the publication EP-579940 (Kolbus GmbH). One signature type is deposited on a conveyer belt from each one of a row of feed points arranged above the conveyor belt. Therein the sequence in which the signature types are assigned to the feed points is the same as the sequence of the signatures in the book block and the feed points and the conveyor belt are synchronised in such a manner, that signatures are deposited on the conveyor belt as imbricated stream sections, each of which corresponds to a book block. This means, that each stream section contains one signature of each type, the signatures being arranged in the correct sequence for the book to be produced.

Because for every book one signature of each type is to be deposited, the system according to EP-0579940 can be operated in a regularly clocked manner, the speed of the conveyor belt being adjusted in such a manner, that in each conveying clock cycle it advances by a distance corresponding to the distance between two feed points plus the required scale spacing. Signature supply at the feed points is adapted to the ratio of the length of the imbricated stream formations to be established and the distances between the feed points. If the distance between the feed points is greater than the length of the imbricated stream sections to be established, a signature is supplied at each feed point in each clock cycle. If the distance between the feed points is smaller than the length of the imbricated stream sections to be established, for example, imbricated stream sections are associated to only e.g. every second or third clock cycle and supply at the feed points is controlled correspondingly.

The system as shortly described above can also be used for establishing imbricated stream sections each containing only selected types of the flat articles available from the feed points. Such individualized stream sections can e.g. constitue groups of supplements to be added to daily newspapers which are such adapted to individual customer needs. For such individualisation of the imbricated stream sections, supply of selected ones of the supplements is suppressed in corresponding clock cycles. The system itself, however, can still be operated rigidly clocked. However, the system does not allow deposition of more than one article from the same feed point in the same imbricated stream section and it does not allow changes in the sequence of the articles in the imbricated stream sections.

A system for establishing a stream of different printed product types, which system does not have the limitations mentioned above, is described in the publication EP-1029705. This system comprises a continuously operated gripper conveyor, with the help of which the products in the stream to be established are conveyed individually held by individual grippers at a regular distance between one another and with an essentially constant speed. For every feed point a conveying system is provided, which comprises individually movable grippers. These are loaded with one product each and are buffered behind the feed point. In correspondence with the product sequence to be established, buffered products are released from the buffers and transferred to corresponding grippers of the gripper conveyor. The stream established in this system is not subject to any conditions with respect to the number and the sequence of products of different types within the stream. This very high flexibility, however, is paid for by a very elaborate device and a relatively elaborate control system. Operation of the system is again rigidly clock cycled. In every cycle a gripper of the gripper conveyor is positioned at every feed point making transfer of one product possible. Transfers are selectively activated or suppressed in correspondence with the product sequence to be established.

BRIEF DESCRIPTIONS OF THE INVENTION

It is the object of the invention to create a method and a device for establishing a stream of different types of flat articles, wherein the sequence of the articles in the stream is to be subjected to less stringent conditions than is the case with the system according to EP-579940. Nonetheless, the device and its control system are to be significantly more simple than is the case for the system according to EP-1029705. The device and the method according to the invention are in particular to be more easily adaptable to varying numbers of articles of a single type to be arranged immediately behind one another in the stream to be established, this means, they are to be very suitable for universal use. Furthermore they are to be easily expandable in any way required.

In the same way as systems according to the state of the art, the method according to the invention uses in essence a conveying surface for the stream to be established and a supply means for every type of article, wherein every supply means leads to a feed point above the conveying surface. The articles are supplied to the feed points and are there deposited on the conveying surface, in order to be conveyed away past further feed points. According to the invention the articles are not deposited individually and the system is not clocked regularly in accordance with such individual deposition, but an imbricated formation of a predefined number of articles is preformed upstream of every feed point and is deposited on the conveying surface as a unit, wherein, of course, such a unit may also contain one article only ("imbricated formation" comprising only a single article).

For preparing imbricated formations to be deposited, the supply means comprises an intermediate conveyor arranged between an article source (e.g., sheet feeder or winding station) and the conveying surface and the intermediate conveyor is controlled or switched on and off independent of intermediate conveyors and article sources of other supply means and preferably independent also of the article source assigned to it. An intermediate conveyor is active, on the one hand when a preformed imbricated formation is to be deposited (deposited on the conveying surface), and on the other hand when a new imbricated formation is to be preformed, wherein these two activity phases advantageously overlap one another at least partially. The article source delivers articles, therefore it is active, when a new imbricated formation is to be preformed.

The device in accordance with the invention comprises a main conveyor and a plurality of supply means directed towards the main conveyor, wherein the main conveyor advantageously comprises a continuously driven conveying surface, on which articles supplied by the supply means are deposited, and wherein every supply means comprises an article source and an intermediate conveyor arranged between the article source and the conveying surface. The supply means are designed for being controlled independently of one another. Also the article source and the intermediate conveyor belonging to the same supply means are advantageously controlled independently of each other, wherein control in essence means switching on and off. The main conveyor, for example, is a conveyor belt, the intermediate conveyors, for example, are also conveyor belts, in particular conveyor belt pairs working in opposite directions or pairs of similar conveying means, between which the imbricated formations are conveyed being held clamped. The entrances of the intermediate conveyors facing away from the main conveyor advantageously are equipped in a universal manner, such that the intermediate conveyors can be coupled with different article sources (e.g., sheet feeder, winding station, on-line supply of articles loosely lying on a conveying surface or held by individually conveyed grippers, such that buffering of the articles behind the feed point is possible).

The intermediate conveyors advantageously lead on to the main conveyor at an inclination from above and in the same direction as the main conveyor. For depositing an imbricated formation, the intermediate conveyor is operated, for example, at a speed, which is essentially the same as the speed of the main conveyor, in such a manner, that the scale spacing of the imbricated formation to be deposited is in essence the same as the scale spacing of the imbricated stream being established on the conveying surface of the main conveyor.

The main conveyor is advantageously operated with a constant speed. Deposition of the imbricated formations may be clocked regularly in such a way, that the imbricated formations deposited on the conveying surface of the main conveyor at every feed point essentially form imbricated stream sections which are separated from one another. On the other hand, deposition at successive feed points may also be adapted to the length of the previously deposited imbricated formations in such a manner, that imbricated formations deposited at successive feed points form an uninterrupted imbricated stream section on the conveying surface of the main conveyor, in which section imbricated formations deposited at successive feed points overlap one another. If an imbricated stream established in this manner is conveyed to a downstream stacking shaft, it is advantageous, to create gaps between imbricated stream sections preformed on the main conveyor or between pluralities of imbricated stream sections constituting preformed stacks, which gaps allow stack ejection without interruption of the article supply to the stacking operation. If the stream to be established is conveyed to a stacking operation, then it is also possible to operate the main conveyor intermittently (start/stop operation), i.e., to stop it during deposition of the imbricated formations. In such a case, a stack stream consisting of partial stacks is established on the conveying surface of the main conveyor instead of the imbricated stream consisting of imbricated stream sections, wherein the stacks of the stream can overlap one another or be arranged one behind the other.

The method and the device according to the invention are suitable in particular for establishing a supply stream of printed products to be made into packages, wherein every package contains printed products of different types, wherein the selection of the printed product types and the number of printed products per type may be the same in every package or may also be different within predefined limits. However, in accordance with the invention it is also possible to establish in the same simple manner packages, each containing only one product of the different types.

BRIEF DESCRIPTION OF THE ACCOMPANYING DRAWINGS

The method and the device according to the invention are described in detail on the basis of the following Figures, wherein.

DETAILED DESCRIPTION OF THE INVENTION

Figure 1:
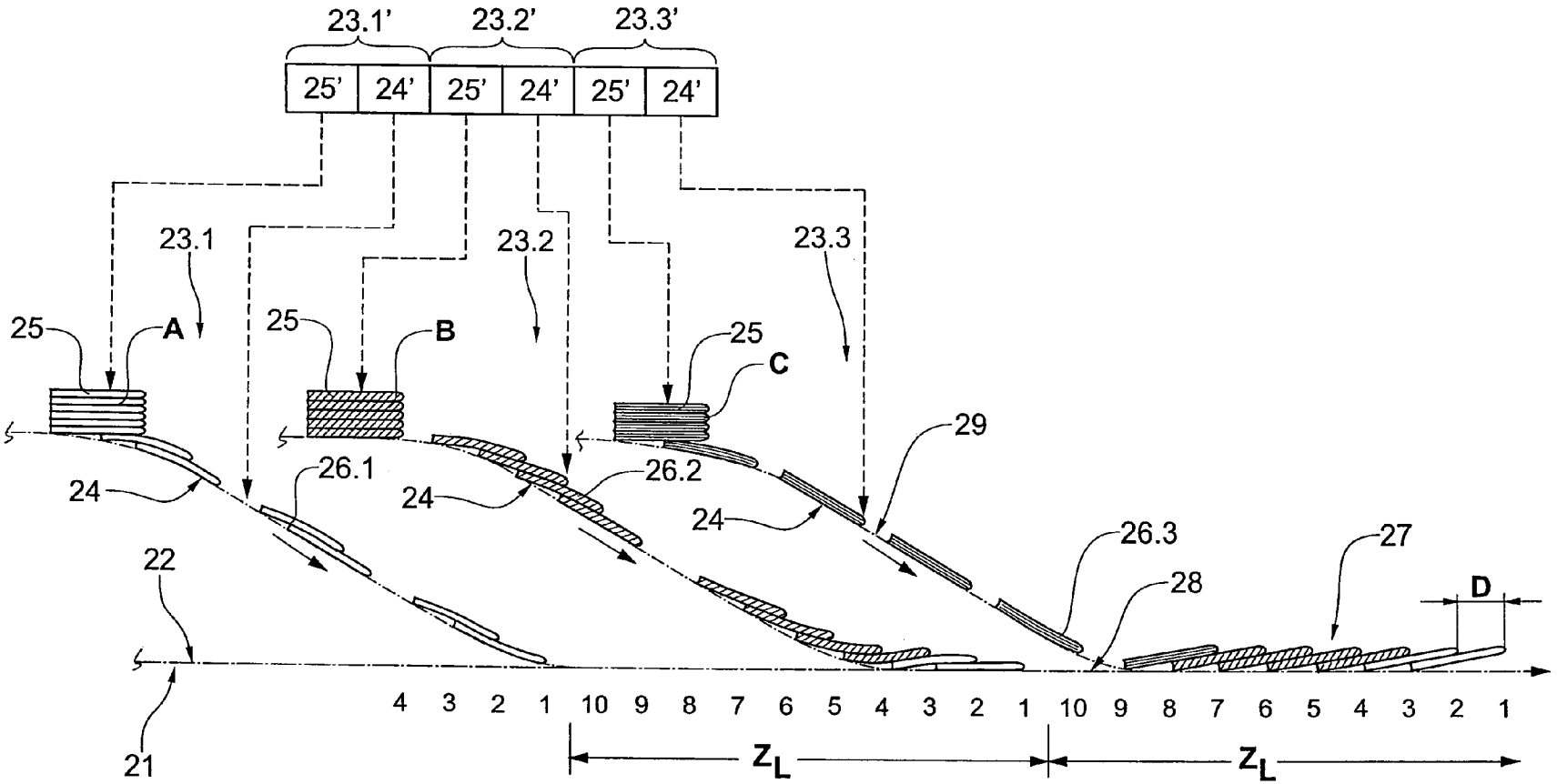
FIG. 1 is a schematic representation of the principle of the method and device according to the invention.

FIG. 1 shows in a schematic manner a first, exemplary embodiment of the method according to the invention. The device for carrying out the method comprises a main conveyor 21 with a conveying surface 22 (schematically depicted as a dot-dash line) and three supply means 23.1, 23.2 und 23.3, wherein each one of the supply means comprises an intermediate conveyor 24 (schematically illustrated as a dot-dash line) and an article source 25 (schematically depicted as a stack). Supply means 23.1 deposits a type A of flat articles on the conveying surface 22, supply means 23.2 a type B and supply means 23.3 a type C.

The articles of the three article types A, B and C of FIG. 1 are shown by different hatchings, they are, however, all depicted as being of the same size. The types of articles which can be processed with the method according to the invention are not, however subject to such conditions, i.e. they may have very different thicknesses and formats or they may all be of the same size. It is equally no prerequisite for the method according to the invention, that the scale spacings D in the stream to be established or in the imbricated formations 26.1, 26.2, 26.3 preformed on the intermediate conveyors 24 are the same for all supply means, as is shown in FIG. 1.

The stream to be established in the process as shown in FIG. 1 shall, for example, comprise uninterrupted imbricated stream sections 27 each comprising two articles of type A, four articles of type B and one article of type C. The preformed imbricated formations 26.1, 26.2, 26.3 in the intermediate conveyors 24 are to be deposited overlapping one another. Furthermore, gaps 28 are to be left between the imbricated stream sections 27, which gaps correspond to three deposited articles. A deposition cycle therefore has to comprise ten clock cycles (for depositing seven articles and for establishing the gap 28). The main conveyor 21 travels through a distance, which corresponds to the scale spacing D in each clock cycle. In FIG. 1, clock cycles and deposition cycles $Z_L$ are indicated as conveying distances. The intermediate conveyors 24, when active, travel in each clock cycle a distance, which corresponds to the scale spacing of the imbricated formation to be preformed (in case of FIG. 1 equal to D).

As already mentioned above, the main conveyor and the intermediate conveyors of the system shown in FIG. 1 are operated at the same speed. This, however, is not a necessity. It is possible without further ado to operate the intermediate conveyors with speeds being different from the main conveyor speed and being different from one another and to correspondingly adjust the scale spacings in the imbricated formations being made ready. It is also not a prerequisite for the method according to the invention, that in all imbricated formations deposited on the main conveyor the scale spacings are the same.

As already described further above, the article sources 25 and the intermediate conveyors 24 of the individual supply means 23.1, 23.2 und 23.3 advantageously are individually controlled, as is very schematically indicated in FIG. 1 with six control units and corresponding data lines (illustrated with broken lines). One pair of control units is assigned to each supply means and is correspondingly designated with 23.1', 23.2' und 23.3'. Each pair comprises a unit 25' for controlling the article source and a unit 24' controlling the intermediate conveyor. It goes without saying, that the control units do not have to be hardware units.

If the imbricated formations being preformed on an intermediate conveyor are not distanced from one another, i.e., if the intermediate conveyor carries a continuous imbricated stream, of which per activity phase one section is to be deposited, then it is not necessary that the article source and the intermediate conveyor are controlled independently of one another.

Figure 2:
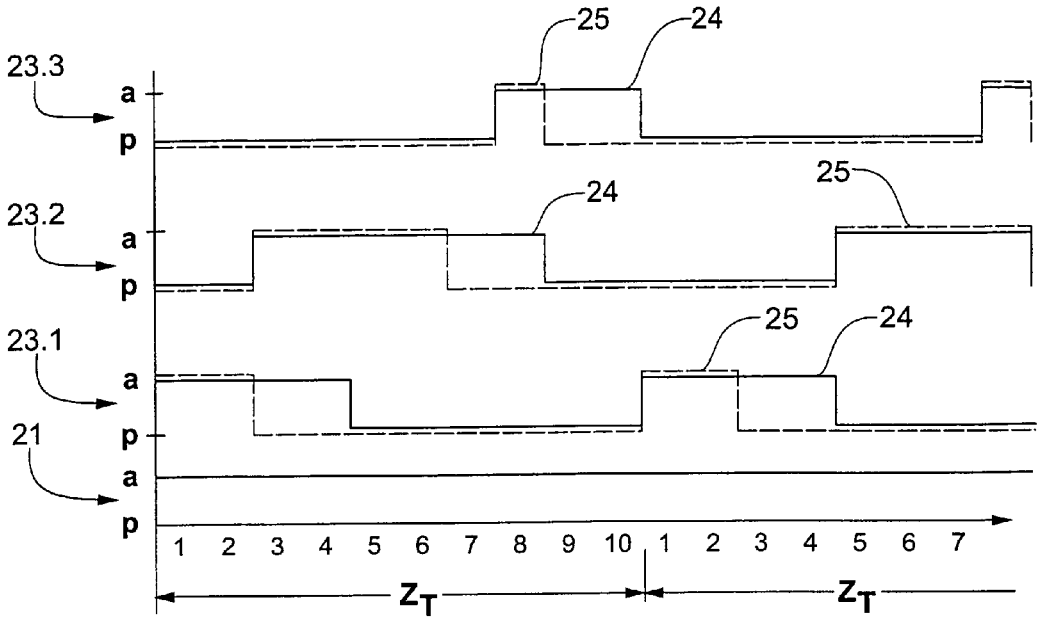
FIG. 2 is an exemplary control diagram for the device according to FIG. 1.

FIG. 2 is a control diagram for the method according to the invention, as essentially illustrated in FIG. 1. On the abscissa (time axis), the clock cycles are consecutively numbered and the deposition cycles $Z_T$ are indicated as time units. On the ordinate the statuses (a=active, p=passive) of the individual components (unbroken line: main conveyor or intermediate conveyor respectively; broken line: article source) are indicated.

The main conveyor 21 is continuously active. On the intermediate conveyor 24 belonging to supply means 23.1, imbricated formations 26.1 containing two articles of type A each and being distanced from one another are preformed, i.e. the intermediate conveyor 24 and the article source 25 are active for depositing and preparing an imbricated formation 26.1 in the clock cycles 1 and 2 of each deposition cycle $Z_T$. The intermediate conveyor alone is active in a number of following clock cycles (according to FIG. 1: clock cycles 3 and 4), in which a spacing 29 between preformed imbricated formations 26.1 is established. In the remaining clock cycles of each cycle $Z_T$ the intermediate conveyor 24 and the article source 25 of the supply means 23.1 are passive.

In the same manner, the intermediate conveyor and article source belonging to supply means 23.2 are active in the clock cycles 3 to 6 (depositing and preforming) and the intermediate conveyor is active in the clock cycles 7 and 8 (spacing 29). In the remaining clock cycles intermediate conveyor and article source are both passive. The intermediate conveyor and the article source belonging to supply means 23.3 are active in the clock cycle 7 (depositing and preforming), only the intermediate conveyor is active in the clock cycles 8 and 9 (spacing 29), both are passive in the remaining clock cycles.

Synchronisation of depositing and preforming is to be adapted to the length of the intermediate conveyor, that is, to the number of imbricated formations which can be fitted on the intermediate conveyor. In FIG. 2, depositing and preforming (active phase of the intermediate conveyor and of the article source) commence simultaneously for all supply means. This is not the case according to FIG. 1, where the same lengths of the three intermediate conveyors and the same spacings 29 of imbricated formations on all intermediate conveyors but different lengths of the imbricated formations 26.1, 26.2, 26.3 render differing phase shifts between depositing and preforming necessary. The spacings 29 (in clock cycles) between preformed imbricated formations may also be different for the different intermediate conveyors, this in particular when processing types of articles having a different length in conveying direction. It is also possible to maintain the stroke of all intermediate conveyors to be the same and constant, independent of the number of articles to be deposited in a deposition step in such a manner, that the sum of the clock cycles, which are available for depositing and for spacing is constant.

Furthermore, the scale spacings D in the imbricated formations 26.1, 26.2, and 26.3 of the individual intermediate conveyors 23.1, 23.2 und 23.3 and correspondingly in the imbricated stream established on the main conveyor 21 may be different.

From FIG. 2 it is apparent, that for establishing individually differently composed imbricated stream sections 27 on the main conveyor, i.e. of imbricated stream sections comprising different article numbers of article types A, B and C, either the cycles $Z_T$ or the gaps 28 have to have different lengths. The individual supply means 23.1, 23.2, 23.3 and the intermediate conveyor 24 and the article source 25 of each supply means have to be controlled in correspondence with the number of articles to be deposited or to be preformed in each cycle.

Figure 3:
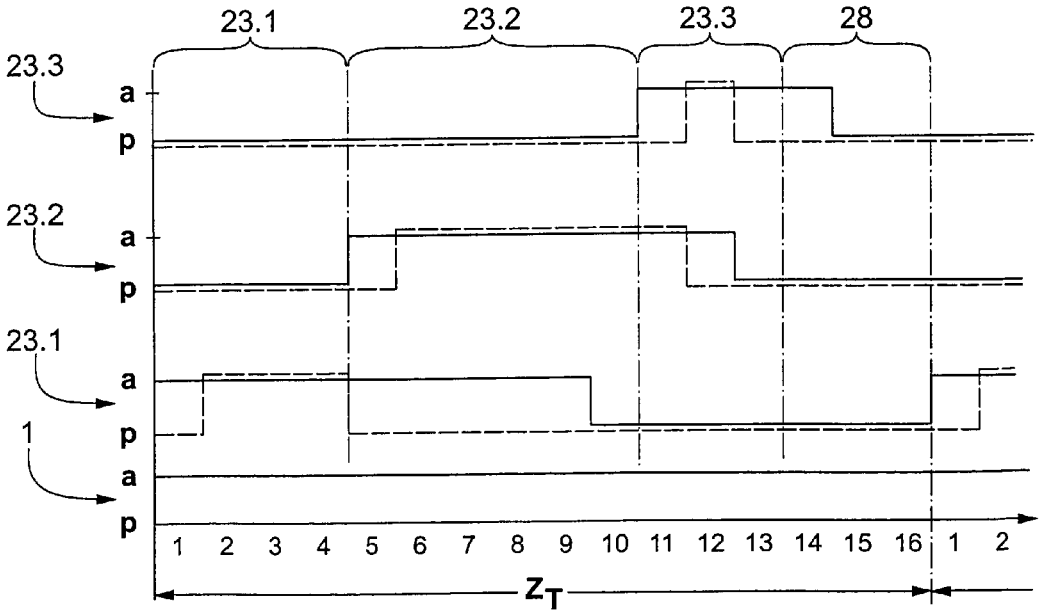
FIG. 3 is another exemplary control diagram for the device according to FIG. 1.

FIG. 3 is a further schematic control diagram for a device as shown in FIG. 1. According to this control diagram it is significantly more simple to produce on the main conveyor 21, individually differently composed and differently long imbricated stream sections 27 or groups of imbricated stream sections respectively.

In accordance with this control diagram, there are clock cycles reserved for deposition by every supply means 23.1, 23.2 and 23.3 (e.g., 23.1: clock cycles 1 to 4; 23.2: clock cycles 5 to 10; 23.3: clock cycles 11 to 13; gap 28: clock cycles 14 to 16), wherein the number of these reserved clock cycles corresponds to a greatest possible imbricated formation 26 to be deposited (e.g., 23.1: max. four articles; 23.2: max. six articles; 23.3; 23.3: max. three articles). If these maximum formations are deposited by all supply means, the imbricated stream sections 27 deposited on the main conveyor form an uninterrupted imbricated stream section. If smaller imbricated formations are deposited, there are gaps between the deposited imbricated formations.

For the cycle $Z_T$ illustrated in FIG. 3, for example, the following is applicable: supply means 23.1: deposit max. four articles, preform three articles; supply means 23.2: deposit max. six articles, preform six articles; supply means 23.3: deposit max. three articles, preform one article. The number of articles being deposited in the cycle depends on the imbricated formations which have been preformed in corresponding earlier cycles. Whether the preformed imbricated formations in the cycle represented are deposited in the next or in a later cycle, is dependent on the length of the different intermediate conveyors or on the number of separate imbricated formations fitting on the intermediate conveyor respectively.

Figure 4:
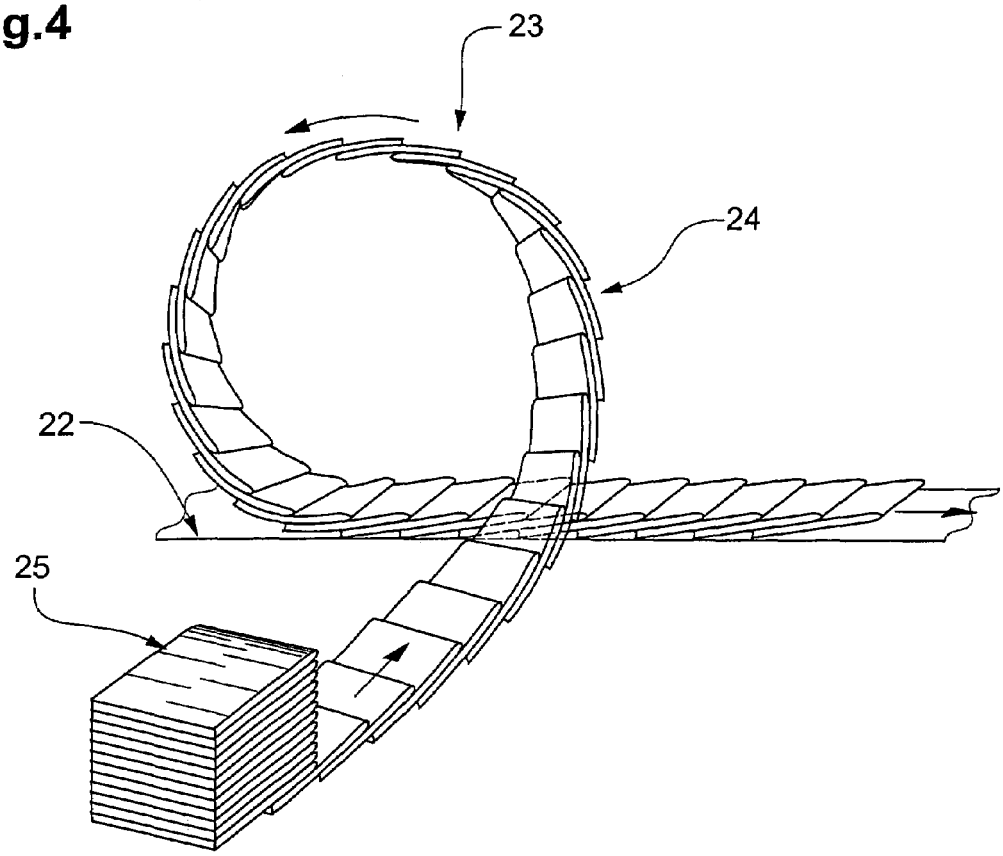
FIG. 4 is a schematic representation of an intermediate conveyor of the invention.
Figure 5:
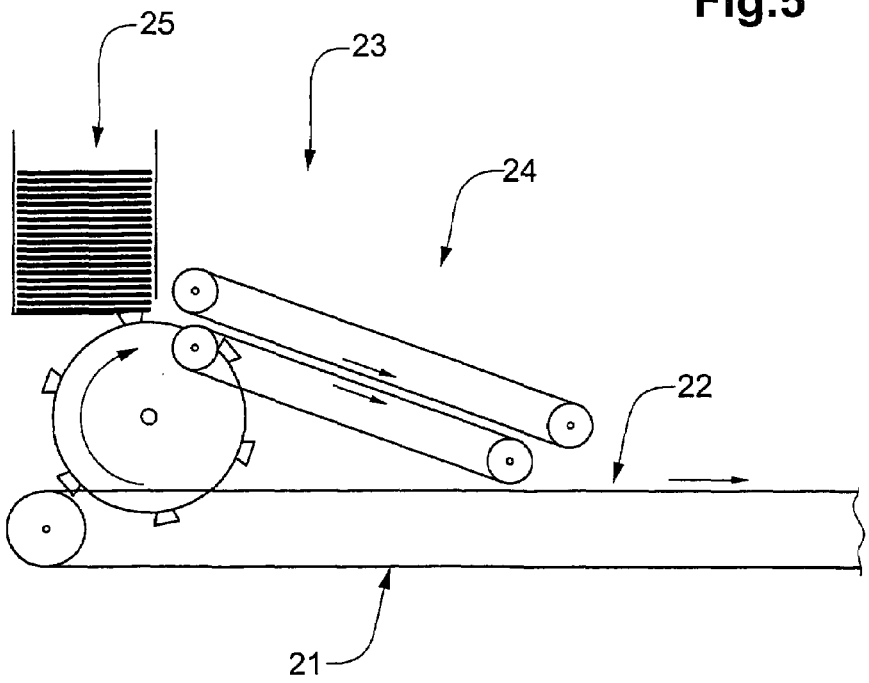
FIG. 5 is a side elevational schematic view of an intermediate conveyor of the invention.

FIGS. 4 and 5 illustrate two examples of supply means 23 for the device according to the invention, each comprising an article source 25 and an intermediate conveyor 24. In FIG. 4, the article source 25 is a stack with articles being removed from its bottom side (as is the case in a sheet feeder), and the intermediate conveyor is a known, twisted conveyor loop, which, for example, is implemented with an inner stationary track of freely rotating rollers and an outer driven circulating belt pressed against the rollers by spring force. The preformed imbricated formations are advanced clamped between the rollers and the belt. A supply means with an intermediate conveyor implemented as a twisted conveying loop is suitable in particular for tight space conditions and is very suitable for manual article supply, wherein an operating person is easily capable of taking care of a plurality of such supply means.

The article source 25 in accordance with FIG. 5 is a sheet feeder arranged above the main conveyor 21 and the intermediate conveyor 24 is implemented as pair of conveyor belts driven in opposite directions and running in an essentially straight line, wherein the conveyor belts are pressed against one another by spring force and the articles are advanced being clamped between them.

Figure 6:
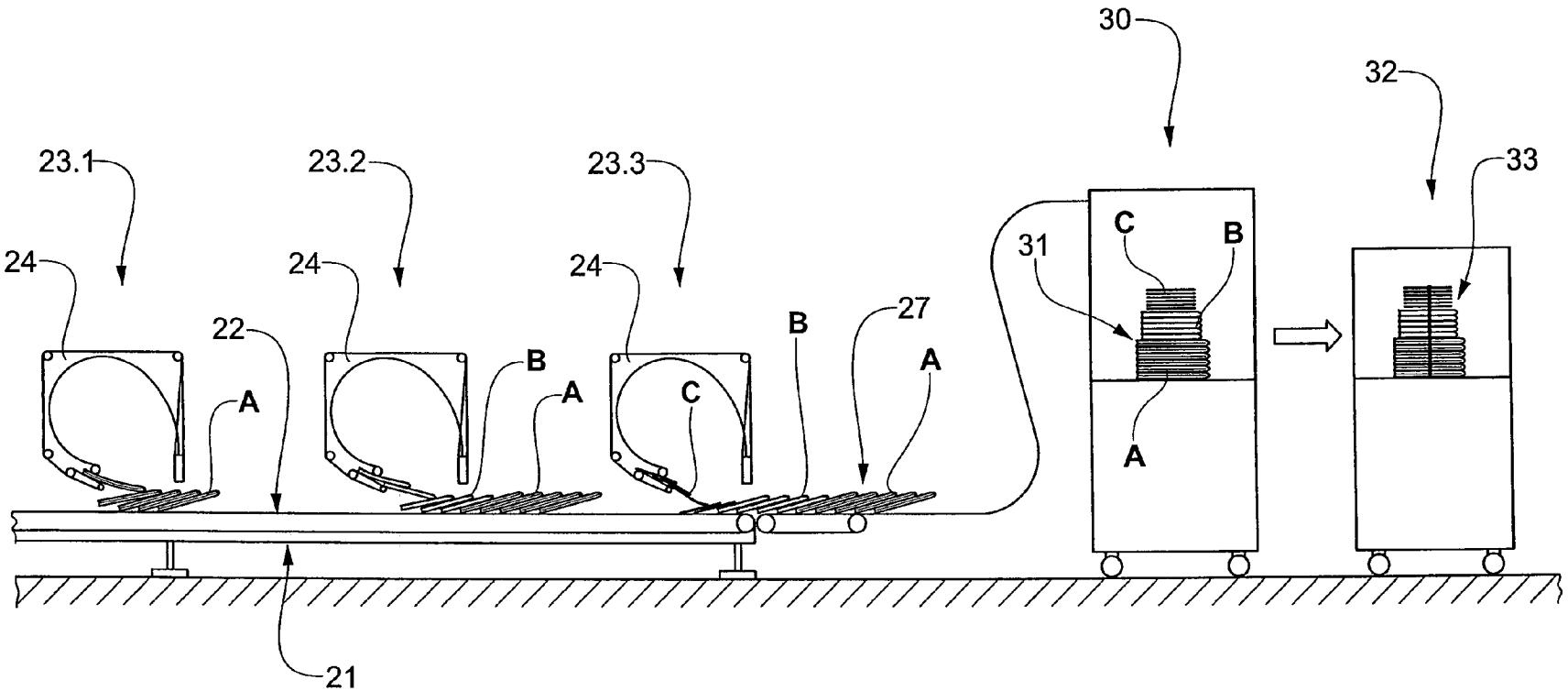
FIG. 6 is a side elevational schematic view of an installation for producing printed product packages according to the invention.

FIG. 6 illustrates an installation for producing packages of printed products, wherein every package may comprise printed products of three different types A, B, and C. In the installation an article stream is created, in which the articles are conveyed in imbricated stream sections 27, wherein every imbricated stream section contains the articles to be included in one stack or package. This stream is supplied to a stacking device 30, in which every imbricated stream section 27 is made into a stack 31. The stacks 31 are then conveyed to a strapping device 32, in which every stack is strapped to form a package 33.

For establishing the stream, a main conveyor 21 and three supply means 23.1, 23.2 and 23.3 are in use, as already described in association with FIG. 1. These are, for example, controlled in accordance with FIG. 2. The supply means comprise each an article source (source of printed products) and an intermediate conveyor 24 according to FIG. 4 (not depicted in FIG. 6). The main conveyor 21 is implemented as a conveyor belt.

If the printed product types A, B and C comprise different formats, then it is advantageous, as is depicted in FIG. 6, to assign to the supply means 23.1 arranged furthest away from the stacking device 30, the largest printed product type and to assign to the supply means 23.3 arranged closest to the stacking device 30, the smallest printed product type. In this manner it becomes possible to establish stable stacks despite the different formats. With the arrangement according to FIG. 6, mixed stacks or packages containing besides printed products, for example, CDs in corresponding envelopes or other flat articles can be produced without any problems. From FIG. 6 it is also apparent, how easily the arrangement can be expanded by adding further supply means.

Instead of providing a stacking device as illustrated in FIG. 6, the imbricated stream sections being conveyed on the main conveyor downstream of the last supply means 23.3, can also be pushed on top of one another to form a stack during conveyance. For this purpose it is necessary, that the imbricated formations deposited by the individual supply means overlap one another (uninterrupted imbricated stream section). A device designed for such stacking by pushing, is described, for example, in the publication DE-19533086 (or U.S. Pat. No. 5,733,099).

The invention claimed is:

1. A method for establishing a stream of flat articles of different article types (A, B, C), the method comprising the steps of:

providing a conveying surface (22) and a plurality of supply means, said plurality of supply means being arranged in succession along the conveying surface and being equipped for depositing one article type each on the conveying surface, preforming imbricated formations in the (26.1, 26.2, 26.3) in the supply means, wherein the imbricated formations comprise a plurality of articles or one article each and wherein imbricated formations preformed by different supply means comprise different numbers of articles, and depositing the preformed imbricated formations (26.1, 26.2, 26.3) as imbricated formations or stacks behind each other on the conveying surface, wherein the succession of deposited imbricated formations on the conveying surface corresponds with the succession of the supply means.

2. The method according to claim 1, wherein the imbricated formations (26.1, 26.2, 26.3) are preformed on an intermediate conveyor (24), by supplying articles from an article source (25) to an entrance to the intermediate conveyor (24), and wherein the articles are later deposited on the conveying surface (22) from an outlet of the intermediate conveyor (24).

3. The method according to claim 2, wherein the intermediate conveyor (24) is switched active for the step of depositing and for the step of preforming and the article source is switched active for the step of preforming.

4. The method according to claim 1, wherein the step of preforming comprises distancing successive preformed imbricated formations (26.1, 26.2, 26.3) from each other on the intermediate conveyor (24).

5. The method according to claim 1, wherein the supply means (23.1, 23.2, 23.3) are controlled such that imbricated formations (26.1, 26.2, 26.3) deposited by succeeding supply means (23.1, 23.2, 23.3) overlap one another on the conveying surface (22) and form an uninterrupted imbricated stream section (27).

6. The method according to claim 5, wherein all imbricated stream sections (27) have a same article composition.

7. The method according to claim 5, wherein gaps are (28) created between successive imbricated stream sections (27).

8. The method according to claim 1, wherein the step of depositing imbricated formations (26.1, 26.2,26.3) is controlled in deposition cycles ($Z_T$) comprising a plurality of clock cycles each, and wherein in each deposition cycle ($Z_T$) a plurality of clock cycles is reserved for deposition by each supply means (23.1, 23.2, 23.3), such that in each deposition cycle an imbricated formation can be deposited by each supply means.

9. The method according to claim 8, wherein in every deposition cycle ($Z_T$) clock cycles are reserved for a gap (28) in the stream to be established.

10. The method according to claim 8, wherein at least one supply means (23.1, 23.2, 23.3) deposits a succession of imbricated formations of different sizes (26.1, 26.2, 26.3).

11. The method according to claim 1 wherein the flat articles are printed products to be supplied to a stacking device.

12. A device for establishing a stream of flat articles of different article types (A, B, C), the device comprising:

a main conveyor (21) comprising a conveying surface (22), a plurality of supply means (23.1, 23.2, 23.3), each supply means being assigned to one article type and equipped for depositing articles on the conveying surface (22) and each one of the supply means (23.1, 23.2, 23.3) comprising an article source (25) and an intermediate conveyor and drive means for driving the article source and the intermediate conveyor of each supply means, and control means for controlling the drive means of each supply means, to generate an imbricated formation of a plurality of articles or one article, independently of drive means of other supply means that generate an imbricated formation of a different number of articles than any other supply mean.

13. The device according to claim 12, wherein the control means of at least part of the supply means are equipped for controlling the article source (25) and the intermediate conveyor (24) independently of one another.

14. The device according to claim 12, wherein the intermediate conveyors (24) are controlled by being switched on and off.

15. The device according to claim 12, wherein each one of the intermediate conveyors (24) comprises two conveying means being pressed against one another by spring force.

16. The device according to claim 15, wherein the two conveying means are two conveyor belts being driven in opposite directions or one conveyor belt co-operating with a passive roller track.

* * * * *

UNITED STATES PATENT AND TRADEMARK OFFICE

CERTIFICATE OF CORRECTION

PATENT NO. : 7,281,709 B2
APPLICATION NO. : 10/839191
DATED : October 16, 2007
INVENTOR(S) : Honegger It is certified that error appears in the above-identified patent and that said Letters Patent is hereby corrected as shown below:

On Title Page, Section [57], Abstract, Line 11, delete “other”, and insert --supply--.

Column 10, Line 6 (Claim 12, Line 6), after “type”, insert --(A, B, C)--.

Column 10, Line 10 (Claim 12, Line 10), after “conveyor”, insert --(24)--.

Signed and Sealed this

Sixth Day of May, 2008

JON W. DUDAS
*Director of the United States Patent and Trademark Office*